US005829468A

United States Patent [19]

Watanabe et al.

[11] Patent Number: 5,829,468

[45] Date of Patent: Nov. 3, 1998

[54] VALVE DEVICE USING PIPES AND METHOD OF MANUFACTURING IT

[75] Inventors: Hachihei Watanabe; Masatoshi Enoki; Katsuaki Nakamura; Tatsuo Matsukuma; Tsuguya Okubo; Akira Yubisui; Takayoshi Yanagida; Hiromi Katahira; Toshiyuki Iwao; Yuji Matsuo, all of Fukuoka-ken, Japan

[73] Assignee: Toto Ltd., Fukuoka-ken, Japan

[21] Appl. No.: 436,374

[22] PCT Filed: Aug. 24, 1994

[86] PCT No.: PCT/JP94/01393

§ 371 Date: May 22, 1995

§ 102(e) Date: May 22, 1995

[87] PCT Pub. No.: WO95/09951

PCT Pub. Date: Apr. 13, 1995

[30] Foreign Application Priority Data

Oct. 6, 1993 [JP] Japan ..... 5-205690

[51] Int. Cl.[6] ..... F16K 43/00; F16K 51/00

[52] U.S. Cl. ..... 137/15; 137/318; 137/801; 251/366; 251/367

[58] Field of Search ..... 251/366, 367; 137/801, 15, 315, 318

[56] References Cited

U.S. PATENT DOCUMENTS

| | | | |
|---|---|---|---|
| 997,464 | 7/1911 | Metcalf | 137/318 |
| 1,016,026 | 1/1912 | Metcalf | 137/318 |
| 2,736,949 | 3/1956 | Kraemer . | |
| 3,269,664 | 8/1966 | Lamb et al. | 137/318 |
| 3,680,349 | 8/1972 | Horton . | |
| 4,083,219 | 4/1978 | Combes et al. . | |
| 4,976,287 | 12/1990 | Sheen | 137/801 |
| 5,022,421 | 6/1991 | Johnson | 137/15 |

FOREIGN PATENT DOCUMENTS

| | | |
|---|---|---|
| 0565114A | 10/1993 | European Pat. Off. . |
| 1217174A | 5/1960 | France . |
| 152336C | 6/1904 | Germany . |
| 59-13528 | 1/1984 | Japan . |
| 60-24251 | 6/1985 | Japan . |
| 8601752A | 3/1986 | WIPO . |

*Primary Examiner*—A. Michael Chambers
*Attorney, Agent, or Firm*—Birch, Stewart, Kolasch & Birch, LLP

[57] ABSTRACT

A valve device using pipe materials in which a fluid control mechanism is arranged and which comprises a valve device body (11) made of a metallic pipe material and having a tubular flange (21) integrally formed on the outer surface of the body so as to protrude therefrom, and a tubular member (12) for forming a flow passage, which is fitted and connected at the base end thereof to the top end of the tubular flange (21). The tubular flange (21) is formed so that the area of the opening at the base end thereof communicating with the flow passage within the valve device body is greater than the area of the opening at the top end of the tubular flange. The inner peripheral portion (21*a*) of the base end of the tubular flange (21) is formed with a smoothly curved surface, and the flow passage is formed along such a curved surface.

15 Claims, 19 Drawing Sheets

VALVE DEVICE USING PIPES AND METHOD OF MANUFACTURING IT

TECHNICAL FIELD

The present invention relates to a valve device comprising a metallic pipe material, a method of manufacturing of the valve device, and an apparatus used for the method of manufacturing thereof.

BACKGROUND ART

Every type of valve device such as a single valve device, a hot and cold water mixing device and the like are produced mainly by casting copper alloy or the like as a raw material. In the production by such casting, the body part of the valve device is produced integrally with delivery tubes and the like projecting from the body part. For example, a hot and cold water mixing device connected to a flow passage water pipes has a tube-like mounting flange for leg tubes connected to the back of the valve device body, which is also integrally formed therewith.

Instead of such a casting method, there is a valve device in which the valve device body and the delivery tubes are separately produced and are integrally connected by brazing or welding (for example, refer to JPA-Hei-1-182423).

FIG. 29 is a schematic view showing an example of such a valve device.

This valve device is produced by providing a hole 51*a* having a diameter $D_1$ on the peripheral wall of the body 51 of a valve device made of a metallic pipe material and welding thereto a delivery tube 52 made of a metallic pipe material having an inner diameter $d_1$ larger than the diameter $D_1$ of the hole 51*a* by electric resistance welding.

However, the delivery tube 52 having an inner diameter $d_1$ greater than the hole 51*a* being connected thereto causes a difference in the inner diameter between the opening of the body and the delivery tube 52, thereby suddenly enlarging the flow passage at the base end of the delivery tube 52. Further, as shown in FIG. 29(*b*), the peripheral portion of the hole 51*a* comes to enter the inner side of the delivery tube 52.

Since, in this way, the flow passage at the hole 51*a* and the base end of the delivery tube 52 is discontinuous in view of the cross-sectional area and form of the flow passage, a stagnation point is caused in the flow along the inner wall of the base end of the delivery tube 52 and, simultaneously, the generation of turbulent flow accompanied by eddies is unavoidable. This makes pressure loss greater as the flow passes therethrough, causing disruption of the delivery amount and noise. In addition, erosion is produced on the inner periphery at the base end of the delivery tube 52 and on the outer peripheral surface of the valve device body 51 connected thereto, and this has a great effect on the durability.

Furthermore, in order to bring the base end of the delivery tube 52 into an abutting engagement with the surface of the valve device body 51 and to join them, complicated working of cutting the base end of the delivery tube 52 along the form of the surface of the valve device body 51 is required, as shown in FIG. 29(*c*). This not only increases the number of the processes of working the delivery tube 52 but also makes the position of the delivery tube 52 apt to be inappropriate if precision in working is not maintained at a high degree, thereby making the process of inspection complicated. In addition, there is a problem in that, in the case where a new valve device body 51 different in diameter from the previous valve device body is used, a delivery tube 52 aligned with the diameter of the new valve device body must be made, thereby lowering production efficiency.

Further, since the end surface at the base end of the delivery tube 52 is used only as a portion where it is joined to the valve device body 51, alignment of the valve device body 51 with the delivery tube 52 using a jig at a process before welding is intricate. In addition, if such an alignment is not sufficient, the position of the delivery tube 52 deviates from the normal position, thereby increasing the rejects of the product.

Moreover, in the case where the conventional valve device as constructed above is, for example, turned with the delivery tube 52 grasped, or is provided at the end of the delivery tube 52 with a change-over handle for changing over a delivery water mode, the force applied to the delivery tube 52 due to such a turning motion acts on the joined portion between the base end of the delivery tube 52 and the surface of the valve device body 51 where stress concentration occurs. However, since the portion where the delivery tube 52 is joined to the valve device body is substantially equal to the wall thickness thereof and has a weak joining force, there is a high risk of the above-described force causing the base end of the delivery tube 52 to become disengaged from the valve device body 51.

As described above, the method of joining the valve device body 51 and delivery tube 51 made of pipe materials merely by brazing or welding leaves problems in the mounting precision and strength of the delivery tube 52, and has another disadvantage of poor durability since erosion is unavoidable.

The present invention has been made taking such points into consideration and aims at providing a technique of constituting a valve device using a pipe material, which is high in precision and superior in mechanical strength.

Namely, the present invention aims at providing the construction of a valve device constituted using a pipe material, which has a high mechanical strength and is superior in function.

Further, the present invention aims at providing a method of manufacturing an accurate and strong valve device using a pipe material and an apparatus used for the method of manufacturing thereof.

DISCLOSURE OF INVENTION

In order to achieve the above-mentioned object, the present invention provides a valve device using a pipe material, which comprises a valve device body in which a fluid control mechanism is arranged therein and on the outer surface of which a tubular flange is integrally formed so as to protrude therefrom, said tubular flange having an area of an opening at the base end thereof communicating with the inner flow passage, greater than an area of an opening at the top end of the tubular flange, and a tubular member for forming a flow passage, which is connected to the tubular flange by fitting the base end of the tubular member into the top end of the tubular flange.

Further, in order to achieve the above-mentioned object, the present invention provides a method of manufacturing a valve device using a pipe material, which comprises the steps of:

a) providing a prepared hole on the side wall of a valve device body made of a metallic pipe material;

b) preparing a metal mold and positioning and arranging the valve device body so that the prepared hole comes to be at a predetermined position with respect to the metal mold;

c) preparing a punch member and arranging the punch member at a position under the prepared hole within the valve device body;

d) moving the punch member from the interior of the valve device body to the outside and raising the peripheral edge portion of the prepared hole to a standing position outwardly of the valve device body;

e) bringing the outwardly raised peripheral edge portion of the prepared hole into an abutting engagement with the metal mold and performing a burring process by means of the punch member, thereby forming a tubular flange; and f) fitting the base end of the tubular member for forming a flow passage, into the top end of the tubular flange for connection thereof.

In order to achieve the above-mentioned object, the present invention provides an apparatus for producing a valve device using a pipe material, which comprises:

a metal mold for forming a tubular flange which is provided at the side wall of a valve device body and to which a tubular member for forming a flow passage is connected;

a pipe material holding mechanism for holding the valve device body made of a metallic pipe material having a prepared hole on the metal mold;

a punch member having a raising part for raising the peripheral edge of the prepared hole to a standing position; and a punch drive mechanism for moving the punch member from the interior of the valve device body toward the outside thereof to thereby integrally form the tubular flange.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

BEST MODE FOR CARRYING OUT THE INVENTION

Figure 1:
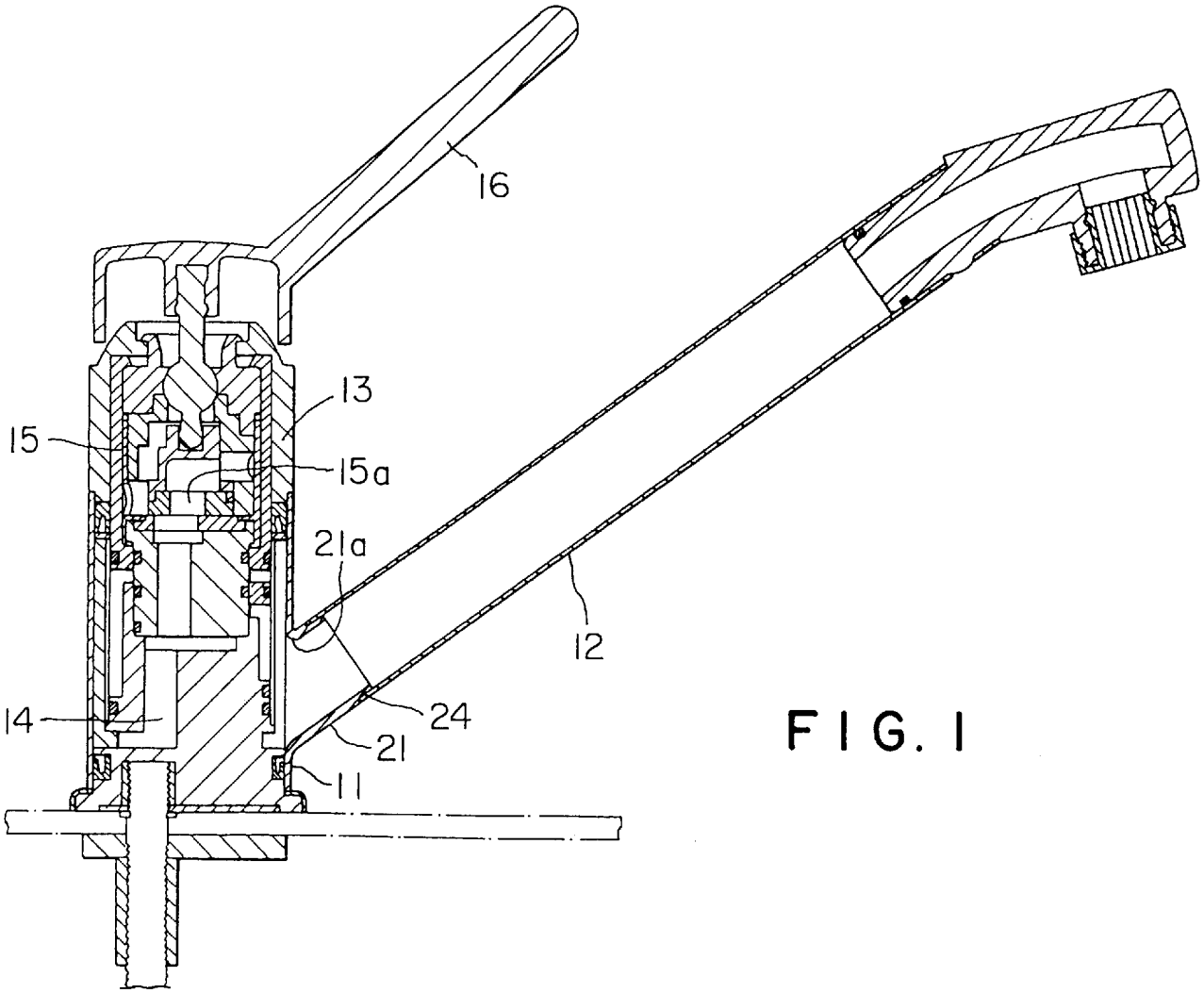
FIG. 1 is a longitudinal sectional view showing an embodiment of a valve device manufactured using a pipe material according to the invention.
Figure 2:
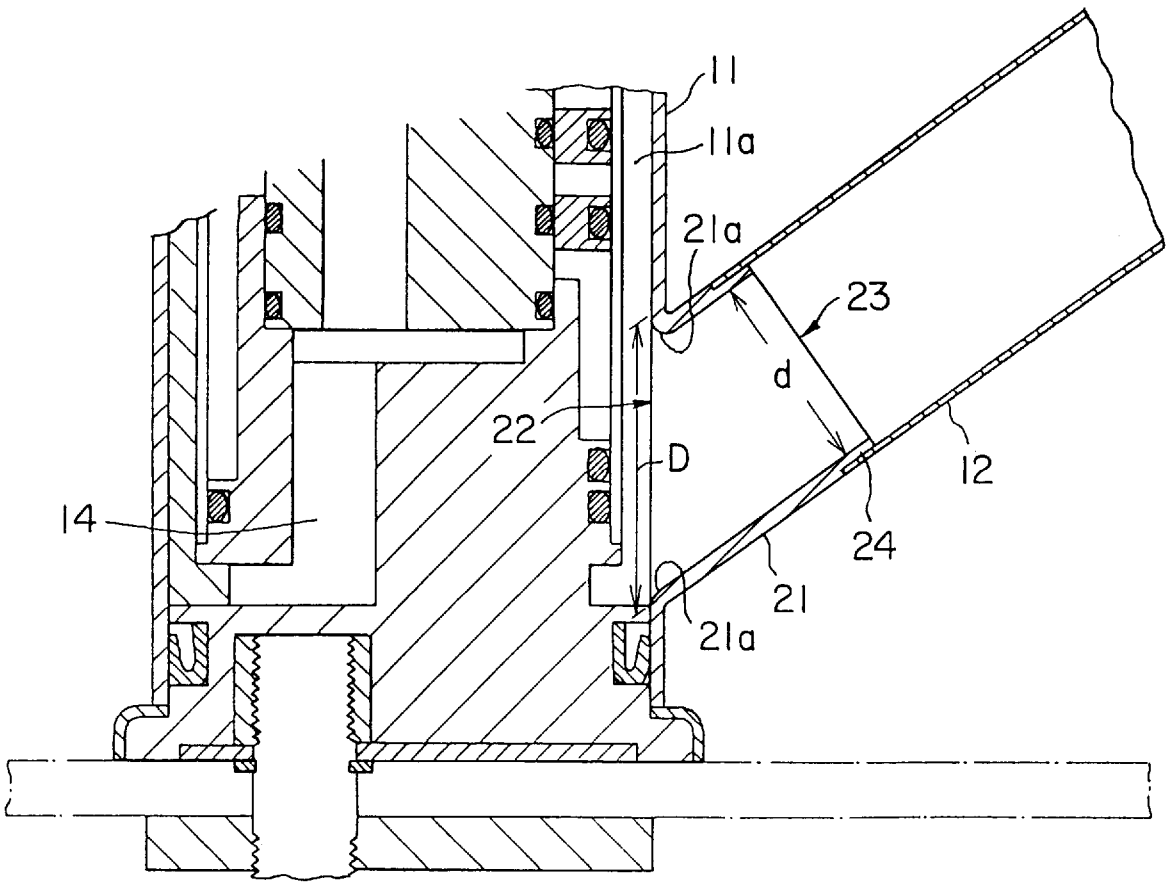
FIG. 2 is a partially enlarged sectional view showing an essential portion of the valve device shown in FIG. 1.
Figure 3B:
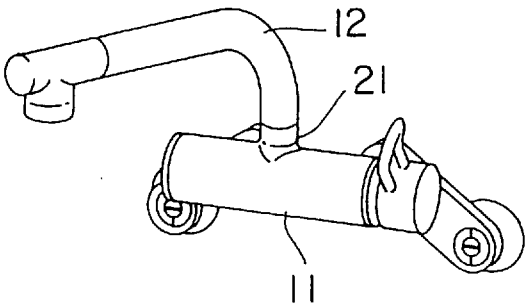
FIG. 3 is a perspective view showing an external appearance of another embodiment of a valve device using a pipe material according to the invention, FIG. 3(*a*) being a single lever type of hot and cold water mixing device, FIG. 3(*b*) being a horizontal type of hot and cold water mixing device, FIG. 3(*c*) being a single lever type of hot and cold water mixing device to which pipes are connected at the right and left ends thereof, and FIG. 3(*d*) being a horizontal type of hot and cold water mixing device which allows a change-over of the delivery for faucet and the delivery for shower.
Figure 3D:
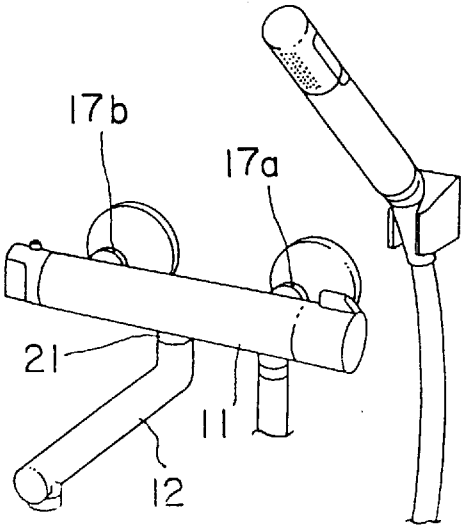
Figure 3A:
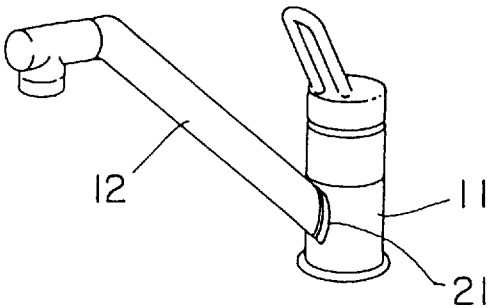
Figure 3C:
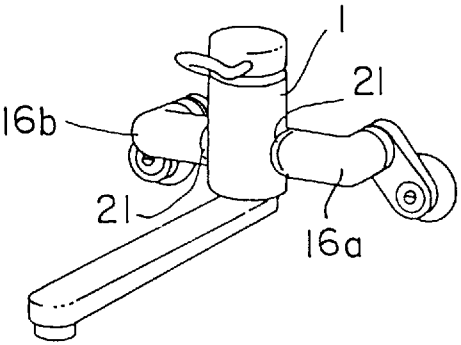

FIG. 1 is a longitudinal sectional view showing an embodiment of a valve device according to the present invention, and FIG. 2 is a longitudinal sectional view, on an enlarged scale, of an essential portion.

The example shown in FIGS. 1 and 2 is of a single lever type of hot and cold water mixing device, which has a body 11 made using a pipe material at the lower half of the device, and a delivery tube 12 made of a pipe material as a raw material is integrally connected to the body 11. The body 11 is made of brass as a raw material, and has an outer diameter of the order of 40 to 60 mm and a wall thickness of the order of 1.5 to 2.5 mm. Also, the delivery tube 12 is made of similar raw material, and has an outer diameter of the order of 15 to 30 mm and a wall thickness of the order of 0.6 to 1.0 mm.

To the upper end of the body 11 is connected a cover 13 made of synthetic resin as a raw material, using a sealing means, and into the interior of the body 11 is incorporated a flow passage block 14 made of synthetic resin, using a sealing means. This flow passage block 14 is connected to a cold water supply pipe and a hot water supply pipe (neither of them shown), which communicate with a cartridge type of valve housing 15 accommodated in the flow passage block 14. A sliding type valve mechanism 15 accommodated in the valve housing 15 is connected to a handle 16, and operation of the handle 16 allows the mixing ratio and flow rate of cold and hot water to be set, so that the mixed water can be supplied to the delivery tube 12.

Joining the delivery tube 12 to the valve device body 11 is performed in such a manner that, as shown in FIG. 2 in detail, the inner peripheral portion of the delivery tube 12 is fitted onto the outer peripheral portion at the front end of the tubular flange 21 integrally formed on the side wall of the body 11 by burring, and the fitted portion is further welded.

The tubular flange 21 is formed so that it extends from the side wall of the body 11 by a length required to join the delivery tube 12 and, in this embodiment, the axis thereof extends in the direction of being inclined upwardly at an angle of 90 degree relative to the axis of the body 11.

The inclined angle can be determined according to a specification of the delivery tube 12. Further, the opening 22 at the base end of the tubular flange 21 communicates with a flow passage (delivery passage) 11*a* within the body 11, and the maximum opening diameter D thereof is larger than the diameter of the opening 23 at the top end of the tubular flange 21. Thus, the area of the opening 22 at the base end of the tubular flange 21 is greater than the area of the opening 23 at the top end. In addition, the inner peripheral portion 21*a* at the base end of the tubular flange 21 is formed with a smooth curved surface, and a flow passage through which water flows from the delivery passage 11*a* to the delivery tube 12 along the curved surface is formed.

Thus, the present embodiment has no sudden expansion and contraction of the area of the flow passage from the valve device body 11 to the delivery tube 12, so that the form of the flow passage can be smoothly made. Accordingly, occurrence of turbulence, as water flows therethrough, and a phenomenon of peeling off the wall of the flow passage can be suppressed, as compared with the construction of a valve device made of conventional pipe materials, thereby allowing a loss in pressure, as water flows therethrough, and noise to be reduced and, simultaneously, preventing the occurrence of erosion.

On the outer peripheral portion at the top end of the tubular flange 21 is formed a stepped portion 24 which is reduced in diameter toward the top end, and the inner peripheral portion at the base end of the delivery tube 12 is fitted onto the stepped portion 24 and connected thereto. When the fitted portion as described above is welded, for example, by silver brazing or electric resistance welding or laser welding or the like, the entire portion where the outer peripheral surface of the tubular flange 21 and the inner peripheral surface of the delivery tube 12 are engaged with each other comes to constitute a joined portion, thereby allowing the delivery tube 12 to be firmly joined to the valve device 11. Further, the greater area of the joined portion enables the joined position of the delivery tube 12 to the valve device body 11 to be correctly determined, thereby allowing the joining operation to be performed with a high accuracy.

Moreover, with the construction of the delivery tube 12 being fitted onto and joined to the tubular flange 21, working the base end portion of the delivery tube 12 into the curved surface so as to correspond to the shape of the outer peripheral surface of the valve device body 11 is not necessary and, therefore, working the delivery tube 12 is easy compared with the construction of the valve device in the prior art.

Further, the construction of the valve device according to the present embodiment in which the delivery tube 12 is joined to the top end of the tubular flange 21, allows a portion of stress concentration due to an external force applied to the delivery tube 12 (the base end of the tubular flange 21) and a joined portion having a lower mechanical strength (the top end of the tubular flange 21) to be separated from each other, so that the strength of the construction of the valve device can entirely be increased. In addition, since the base end of the tubular flange 21 is formed by the smoothly curved surface, a degree of stress concentration is dispersed and damage to the base end can be prevented.

Moreover, work hardening due to burring occurs in the tubular flange 21, which is, however, heated in the subsequently performed welding process for the delivery tube 12 and re-crystallization occurs. This improves the toughness and resistance to corrosion of the tubular flange 21, and the strength is further increased in addition to the mechanical strength due to burring. Therefore, in spite of the connection of the body 11 and delivery tube 12 made of pipe materials, the construction of the valve device having a strength sufficient for use can be obtained. In addition, since the region to be heated is shifted from the base end of the tubular flange 21 to the delivery tube, the joining operation can be completed with the minimum required heating, and softening due to overheating of the base end of the tubular flange 21 can be suppressed.

The joined construction of the body 11 and delivery tube 12 as described above can be arbitrarily applied to the other portion of the valve device.

FIG. 3 shows examples of a various types of valve devices to which the joined construction according to the present invention can be applied.

FIG. 3(*a*) shows a single type of hot and cold water mixing device as explained above, and an example in which the present invention is applied to the joined portion of the body 11 and the delivery tube 12 extending obliquely upwardly from the body 11.

FIG. 3(*b*) shows an example in which the delivery tube 12 is joined to the top surface of the body 11 of a horizontal type of hot and cold water mixing device, and the tubular flange 21 is formed on the upper surface of the valve device body 11 made of a pipe material by burring, and the base end of the delivery tube 12 is connected to the tubular flange 21.

FIG. 3(*c*) shows an example in which leg pipes 16*a* and 16*b* from the piping on the wall are connected to the right and left sides of the body 11 of a hot and cold water mixing device. Also, in this example, the tubular flange 21 for the leg pipes 16*a* and 16*b* is formed on the body 11 made of a pipe material at the right and left thereof by burring for the connection of the leg pipes.

FIG. 3(*d*) shows an example in which the present invention is applied to a portion where the delivery tube 12 is connected to the lower surface of the body 11 and the other portions where leg pipes 17*a* and 17*b* from the piping on the wall are connected to the body 11. On the lower surface of the body 11 is formed the tubular flange 21 for the connection of the delivery tube 12 and, simultaneously, on the back thereof are formed the tubular flanges for the connection of the leg pipes 17*a* and 17*b*.

Next, a method of providing the tubular flange 21 on the valve device body 11 by burring will be described.

FIGS. 4 to 8 are views showing a method of forming the tubular flange 21 on the valve device body 11 made of a metallic pipe material using an inclined press type burring apparatus.

Figure 5:
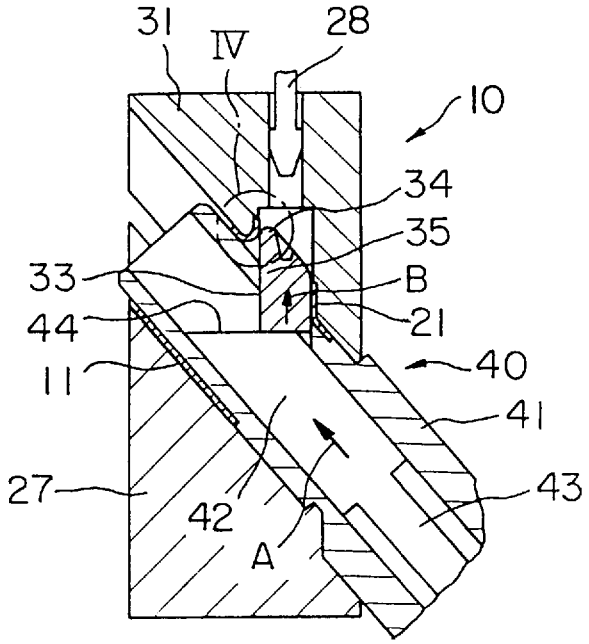
FIG. 5 is a longitudinal sectional view showing an embodiment of an apparatus for performing a burring process of a tubular flange to a valve device body according to the invention.
Figure 6:
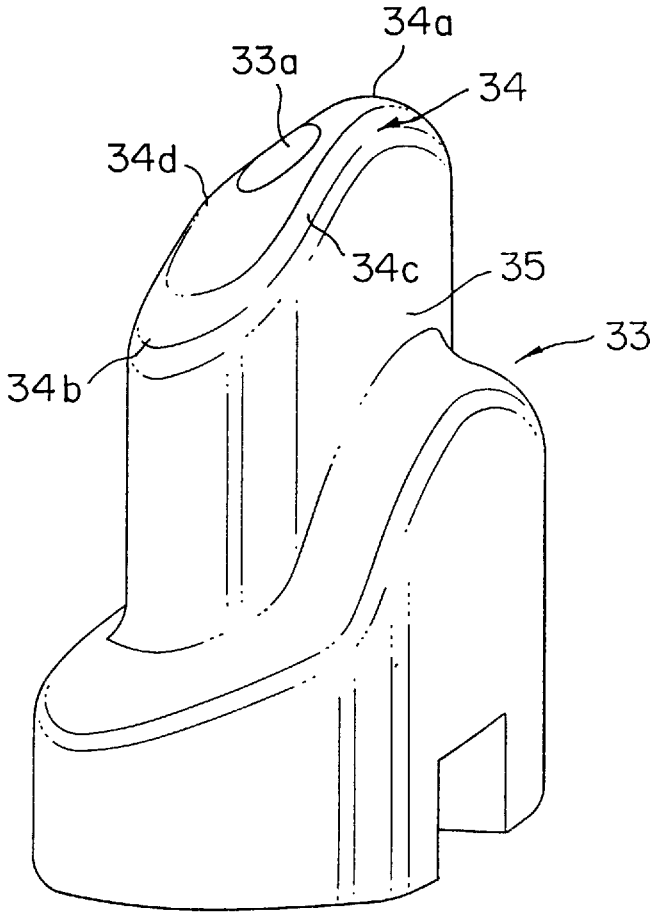
FIG. 6 is a perspective view showing an external appearance of an embodiment of a punch member used for the burring apparatus.
Figure 7:
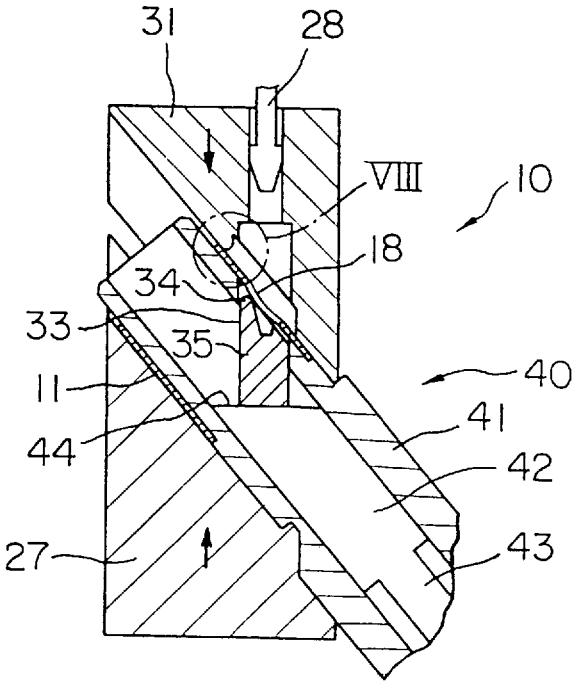
FIG. 7 is a longitudinal sectional view showing the function of the burring apparatus shown in FIG. 5.

As shown in FIGS. 5 to 7, the burring apparatus 10 comprises a lower die 27, a metal mold which also serves as an upper die, a knock-out member 28 and a push-up mechanism 40, which in turn comprises a punch holder 41, a cam slider 42 which is adapted to slide in the punch holder 41, and a drive cylinder 43 for moving the cam slider 42 in a reciprocating motion. A burring tool is adapted to be driven so as to be directly moved from the interior of the body 11 made of a metallic material to the outside by the reciprocating motion of the cam slider 42.

Figure 9:
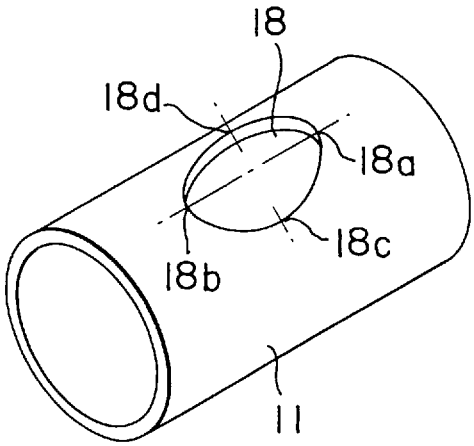
FIG. 9 is an external appearance perspective view showing an embodiment of a valve device body composed of a metallic pipe material to which a burring process is applied.

Namely, the body 11 is formed in advance with a prepared hole 18 at a predetermined position, as shown in FIG. 9, and the body 11 having such a prepared hole 18 is positioned and arranged between the lower die 27 and the metal mold 31. In a region within the body 11 corresponding to the prepared hole 18 is arranged a burring tool 33 which is guided and supported by the punch holder 41 of the push-up mechanism 40, as shown in FIG. 7.

Figure 8:
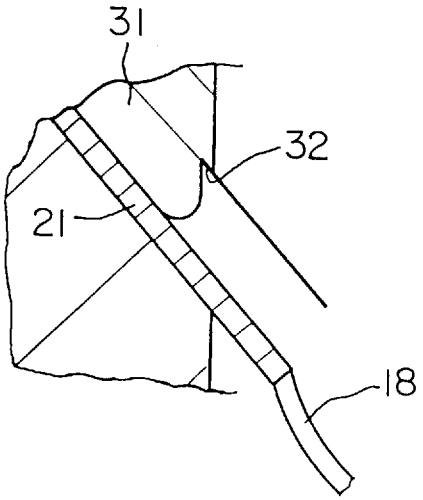
FIG. 8 is a sectional view, on an enlarged scale, of a portion of VIII in FIG. 7.

Further, in a region of the metal mold 31 corresponding to the prepared hole 18 is provided a stepped portion 32 for forming a difference in level on the outer peripheral surface of the tubular flange formed when a raising operation for raising the peripheral edge of the prepared hole 18 outwardly of the body 11 is applied, as shown in FIG. 8.

Figure 4:
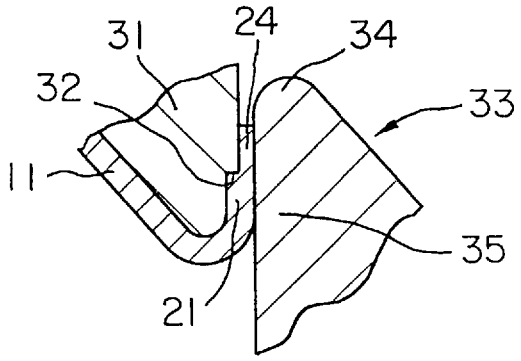
FIG. 4 is a sectional view, enlarged in a portion of IV in FIG. 5, showing a method of performing a burring process of a tubular flange to a valve device body according to the invention.

As shown in FIGS. 4 and 6, the burring tool is composed of, for example, a cylindrical punch member 33 having a form of the top end being obliquely cut, and this punch member 33 comprises a raising part 34 at the former step includes an outer peripheral edge of which has the cross section of a circular arc, and a ironing part 35 at the latter step having a diameter equal to or somewhat greater than that of the raising part 34.

The raising part 34 of the punch member 33 is smoothly formed with chamfering parts 34*a*, 34*b*, 34*c* and 34*d* having different diameters. These chamfering parts are so formed that the radii of the parts 34*a* and 34*b* (refer to FIG. 6) which are brought into an abutting engagement with the peripheral edges 18*a* and 18*b* respectively (refer to FIG. 9) existing in the axial direction are smaller than the radii of the parts 34*c* and 34*d* (refer to FIG. 6) which are brought into an abutting engagement with the peripheral edges 18*c* and 18*d* respectively (refer to FIG. 9) existing in the positions intersecting with the axial direction at a right angle.

In the embodiment shown in FIG. 6, the chamfering part 34*a* at the top of the punch member 33 has the smallest radius. Besides, the punch member 33 is provided at the top thereof with a recess 33*a* into which a knock-out member 28 for pressing out the punch member 33 is inserted.

At the top end of the cam slider 42, which is in contact with the lower end of the punch member 33, is formed a cam surface 44 inclined relative to the axis of the cam slider 42, as shown in FIGS. 5 and 7, and movement of the cam slider 42 in the direction indicated by the arrow mark A causes the punch member 33 to be pushed up outwardly in the radial direction indicated by the arrow mark B.

Next, a method of burring the body 11 made of a metallic pipe material in the present invention will be described.

In applying the burring process to the body 11, the body 11 is mounted on the push-up mechanism 40 with the lower die 27 and metal mold 31 being opened and, subsequently, the lower die 27 and the metal mold 31 are clamped. Thus, the punch member 33 is positioned and arranged at a position within the body 11 where it corresponds to the prepared hole 18, as shown in FIG. 7.

In this situation, the cam slider 42 of the push-up mechanism 40 is moved in the axial direction indicated by the arrow mark A (refer to FIG. 5). This causes the punch member 33 to be pushed up toward the outer diameter side shown by the arrow mark B by the cam surface 44.

When the punch member 33 is pushed up from the interior of the body 11 toward the outside, the peripheral edge of the prepared hole 18 is first raised by the raising part 34 to a standing position so that the tubular flange 21 is formed so as to be flared, as shown in FIG. 4.

Since the chamfering parts of the raising part 34 of the punch member 33 are different in radius, such raising begins from the chamfering part 34*a* having the smallest radius and, subsequently, is performed on the chamfering part 34*b* and, further, in order of the chamfering parts 34*c* and 34*d*. Namely, the raising process begins from the peripheral edge 18*a* existing in the axial position of the prepared hole 18 and, subsequently, is performed on the peripheral edge 18*b* and, further, in order of the peripheral edges 18*c* and 18*d* existing in the positions intersecting with the axial direction at a right angle.

Raising the peripheral edges 18*a* and 18*b* in the axial direction of the prepared hole 18 earlier than the peripheral edges 18*c* and 18*d* in the positions in the direction intersecting with the axial direction at a right angle, as described above, allows cracking of the peripheral edges 18*a* and 18*b* to be prevented from occurring. The applicant confirmed in various experiments that providing an order in the raising of the peripheral edges of the prepared hole, as described above, remarkably reduces the examples of cracking, as compared with the case where the peripheral edges are simultaneously raised.

Figure 12:
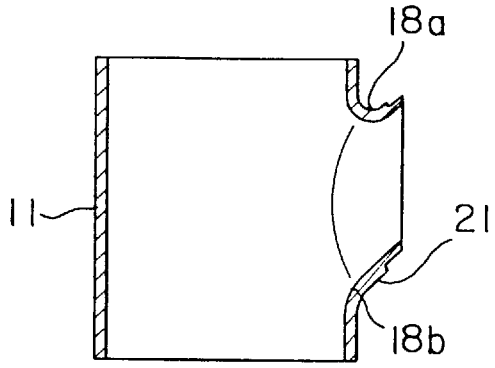
FIG. 12 is a longitudinal sectional view showing an embodiment of a valve device body on which a burring process of a tubular flange according to the invention is performed.

Besides, in the case where burring is performed with the punch member 33 in the form of the top end being obliquely cut as shown in FIG. 6, the tubular flange 21 in the form of being inclined relative to the body 11 is formed, as shown in FIG. 12, and a greater deformation is caused in the portion of the peripheral edge 18*a*, with which the chamfering part 34*a* of the punch member 33 is brought into an abutting engagement, than the portion of the peripheral edge 18*b*, with which the chamfering part 34*b* is brought into an abutting engagement.

In the process of raising, since the outer peripheral portion of the tubular flange 21 is regulated by the metal mold 31, which is provided with the stepped part 32, the tubular flange 21 is compressed between the metal mold 31 and the punch member 33, so that the difference in level 24 is integrally formed on the outer peripheral surface of the tubular flange 21.

After such a raising, an ironing is performed on the inner peripheral surface of the base of the tubular flange 21, and the inner peripheral surface of the tubular flange 21 is secondarily compressed and deformed. In this ironing, the thickness is preferably reduced by the ironing by 30 to 40%. This is because, if the thickness is reduced by more than such an amount, the base end of the tubular flange 21 comes to be easily broken, and, on the contrary, if the reduction in thickness is less than 30%, a required difference in level cannot be formed on the outer peripheral portion of the tubular flange 21.

Figure 10:
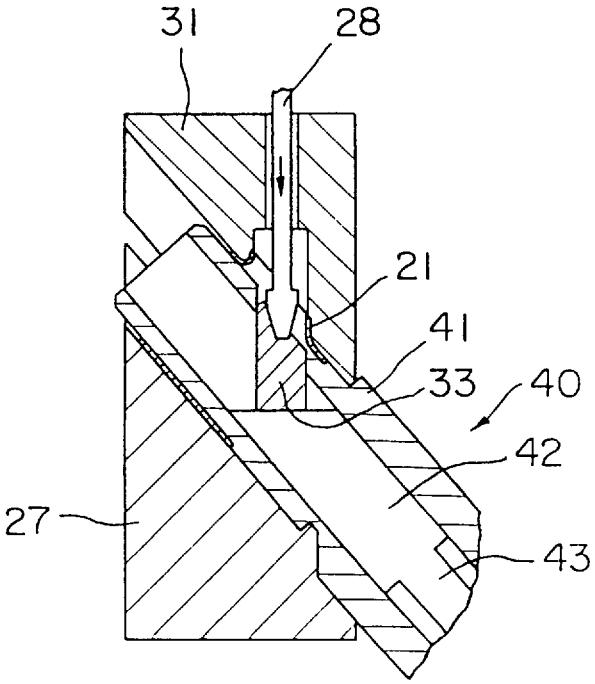
FIG. 10 is a longitudinal sectional view showing the action of the burring apparatus shown in FIG. 5.

After applying the press burring process to the body 11 made of a metallic pipe material, as described above, the knock-out member 28 is moved downward, as shown in FIG. 10 and, simultaneously, the cam slider 42 is moved to the original place and the punch member 33 is accommodated into the punch holder 41.

Figure 11:
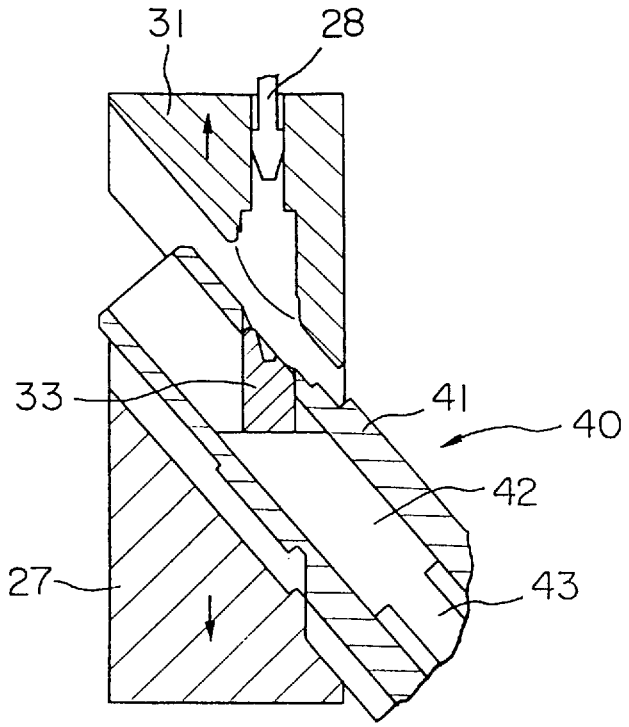
FIG. 11 is a longitudinal sectional view showing the action of the burring apparatus shown in FIG. 5.

Subsequently, after the knock-out member 28 is moved upward, the lower die 27 and metal mold 31 are opened, as shown in FIG. 11, and the body 11, which has been made into the form shown in FIG. 12 by the burring process, is taken out.

In this way, the peripheral edge of the prepared hole 18 is raised by the raising part 34 of the punch member 33 to thereby perform the flaring of the tubular flange, and simultaneously, the outer peripheral portion thereof is regulated by the metal mold 31 and the body 11 is secondarily compressed and deformed simultaneously with the raising accompanied by a linear motion of the punch member 33 to the outside thereby integrally forming the stepped portion 24; therefore, a plastic deformation of the tubular flange 21 having the stepped portion 24 is caused, so that the amount of spring-back can be reduced.

Since, after the raising by the raising part 34 of the punch member 33, the ironing by the ironing part 35 is further applied to the tubular flange 21, such a secondary compression and deformation enables the spring-back amount to be more reduced, thereby improving the precision in working.

Figure 13:
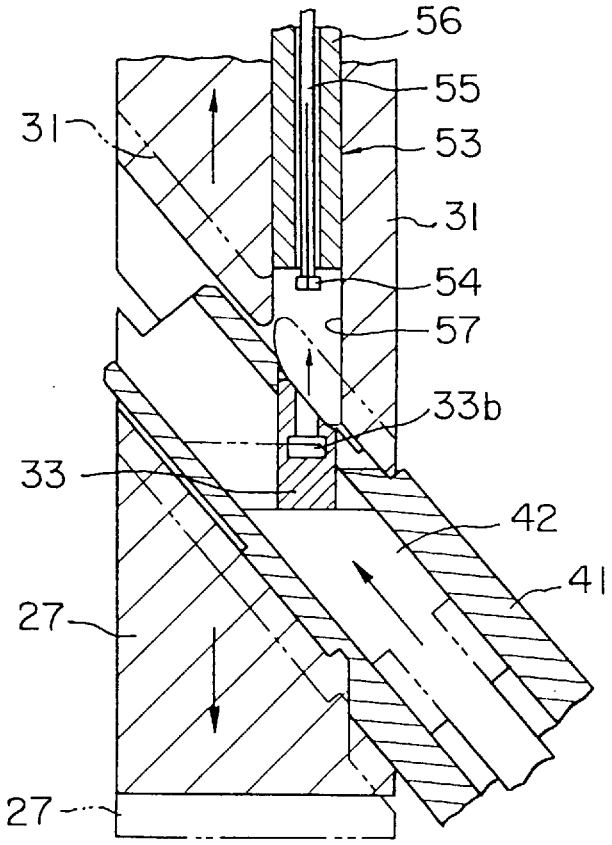
FIG. 13 is a longitudinal sectional view showing further embodiment of a burring apparatus different in the construction of the punch member.
Figure 14:
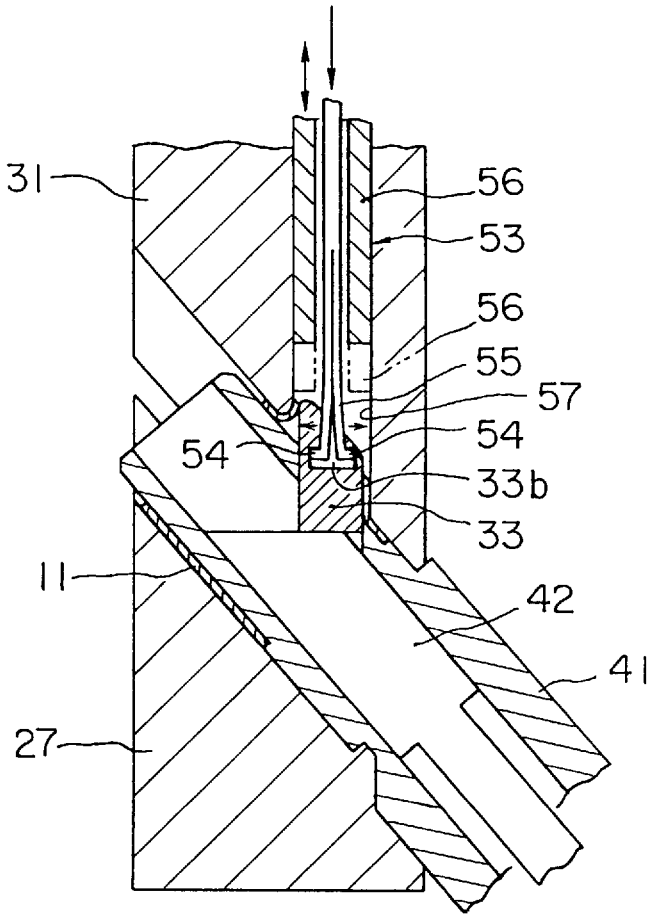
FIG. 14 is a longitudinal sectional view showing the action of the burring apparatus shown in FIG. 13.

FIGS. 13 and 14 are views corresponding to FIGS. 7 and 10 showing the other example of a process of taking out the punch member 33 after completion of the burring process.

In the above-mentioned embodiment, the punch member 33 is accommodated by being pushed into the punch holder 41 by the knock-out member 28 after completion of the burring process, while in the present embodiment, the punch member 33 is pulled out upwardly by the punch holder 41. Namely, in the present embodiment, the punch member 33 is formed in the center of the head thereof with a stepped engaging hole 33*b* which is smaller in the diameter of the inlet and greater in the diameter of the interior.

The metal mold 31 is further formed, at the position opposite the punch member 33, with a die bore 57 having a somewhat greater diameter concentrically with the punch member 33, and a punch hanger 53 is arranged within the bore 57. The punch hanger 53 has engaging claws 54 at the lower end thereof, and is composed of a hanger leg 55 made of spring steel the lower portion of which is split longitudinally into two portions, and a hanger holder 56 for slidably accommodating the hanger leg 55 in the axial direction. The punch hanger 53 is driven by a drive means (not shown) and is moved up and down in the die bore 57, so that it comes into and out of the hanger holder 56, thereby opening and closing the hanger leg 55. In the situation where the hanger leg 55 is closed, both engaging claws 54 are allowed to come into and out of the engaging bore 33*b* of the punch member 33.

Upon completion of the burring process, the punch hanger 53 is moved downward and the lower end of the hanger leg 55 is inserted into the engaging hole 33*b* of the punch member 33. Thereafter, when only the hanger holder is moved upward, the hanger leg 55 is opened, as shown in FIG. 14, so that the engaging claws 54 engage the stepped portion of the engaging hole 33*b* of the punch member 33. Subsequently, when the punch hanger 53 is moved upward with the stepped portion being engaged by the engaging claws 54, the punch member 33 is drawn into the die bore 57 along with the punch hanger 53.

Subsequently, the metal mold 31 and the lower die 27 are moved up and down, respectively, and the valve device body 11 is pulled out from the punch holder 41.

In the case where a subsequent burring process is performed, the punch member 33 which has been pulled up is inserted into the punch holder 41 by moving the punch hanger 53 downwardly. Then, only the hanger holder 56 is moved downwardly again to close the hanger leg 55, and the punch hanger 53 is moved upwardly to the original position with the punch member 33 being left in the punch holder 41.

Use of the punch hanger 53 as described above allows the punch member 33 to automatically come into and out of the punch holder 41 so that the burring process can continuously be carried out.

Figure 15:
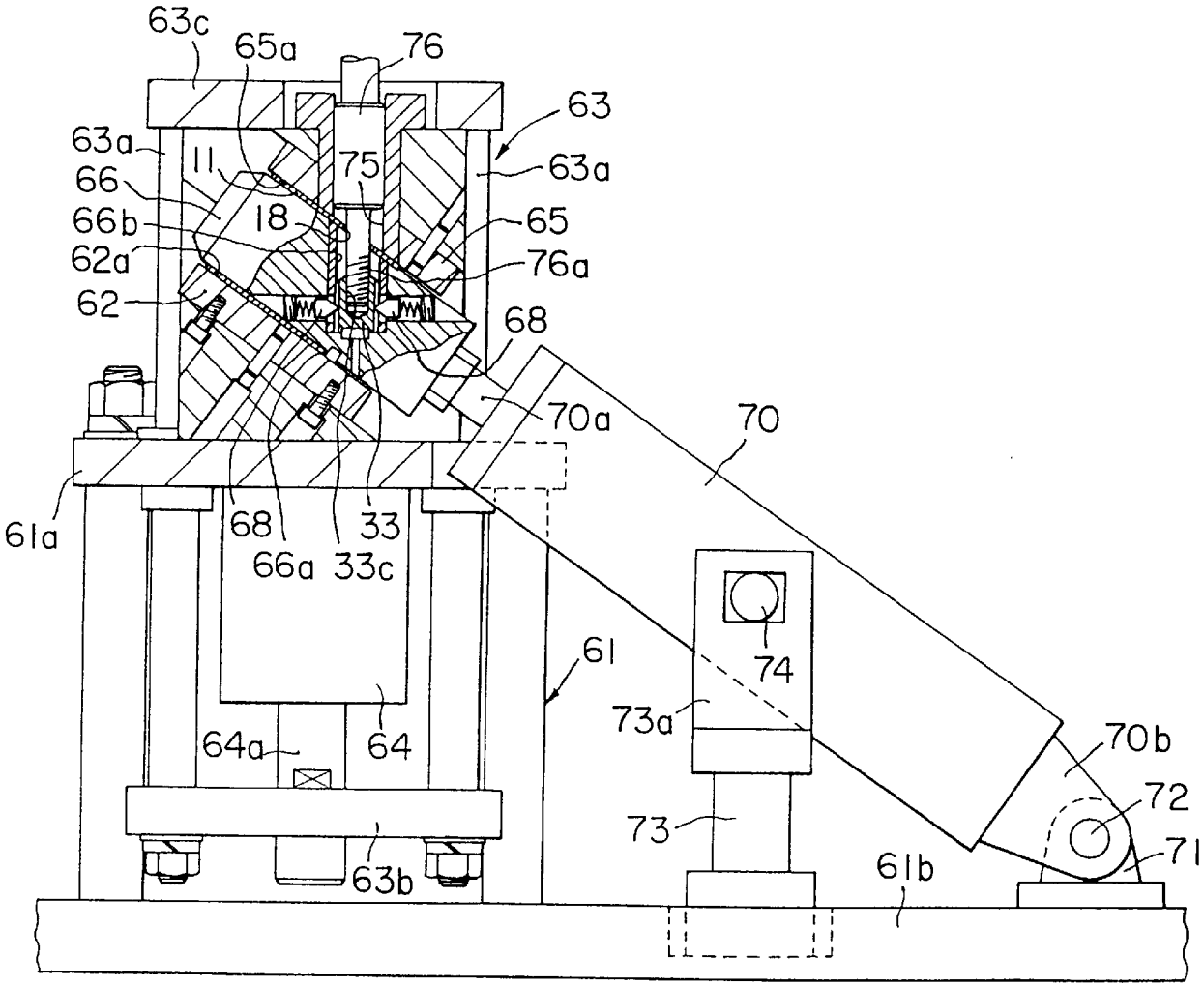
FIG. 15 is a side view including a partial section, showing an embodiment of an automatic burring apparatus according to the invention.

FIGS. 15 and 16 are views showing an example of an apparatus for automatically mounting and dismounting a work 11 (valve device body) between the upper and lower metal molds.

In FIGS. 15 and 16, reference character 61 indicates a burring base in a burring apparatus, which is provided on the top 61*a* thereof with a lower die 62 secured thereto so as to be inclined downwardly to the right, said lower die 62 having an upper surface formed with a circular arc surface 62*a*. Moreover, a lifting frame 63 is fitted for up and down motion along guide rods 63*a* on the top 61*a* of the burring base 61. On the back surface of the top 61*a* of the burring base 61 is vertically provided a hydraulic cylinder means 64, which has an output shaft 64*a* connected to the lower portion 63*b* of the lifting frame 63.

Further, to the top 63*c* of the lifting frame 63 is secured an upper die 65 inclined downwardly to the right and facing the lower die 62, the upper die 65 having a lower surface formed with a circular arc surface 65*a* which has the same and isometric shape as the circular arc surface 62*a* of the lower die 62. In the position of both circular arc surfaces 62*a* and 65*a* is arranged a cylindrical punch holder 66 along each of the inclined circular arc surfaces 62*a* and 65*a*. The punch holder 66 is formed in the center thereof with a locating stepped part 66*a* for determining a position into which the valve device body 11 is to be inserted. Further, the punch holder 66 is provided with a vertical hole 66*b* in which the punch member 33 is fitted for up and down motion.

To one end of the punch holder 66 is connected, for example, an output shaft 70*a* of a cylinder means 70 such as an air cylinder, which is pivotally connected at the base end 70*b* thereof by a support shaft 72 to a bracket 71 provided on the base plate 61*b* of the burring base 61. A lifting cylinder means 73 is vertically provided for up and down motion on the base plate 61*b* directly under the substantially center portion of the cylinder means 70. The output part 73*a* of the lifting cylinder means 73 is connected to a pin 74 additionally provided in the center of the cylinder means 70, so that operation of the lifting cylinder means 73 enables the entire cylinder means 70 to be pivotally moved about the support shaft 72.

Meanwhile, in the upper die 65 positioned directly above the punch member 33 is provided a vertical bore (bore for movement of die), in which a punch hanger 76 is fitted for up and down motion. Further, the threaded portion 76*a* of the punch hanger 76 is removably connected to the threaded hole 33*c* formed on the top of the punch member 33, and the punch hanger 76 is connected to a lifting device (not shown) which is moved up and down while being rotated.

The operation of the present embodiment will be explained.

Figure 16B:
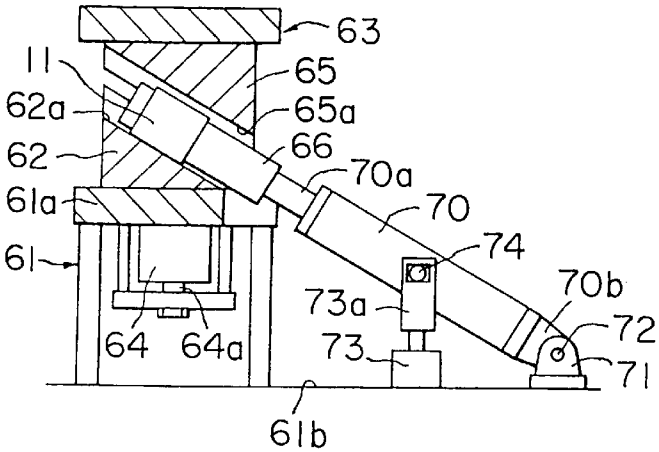
FIGS. 16*a*–16*d* are is a view showing the action of the automatic burring apparatus shown in FIG. 15.
Figure 16D:
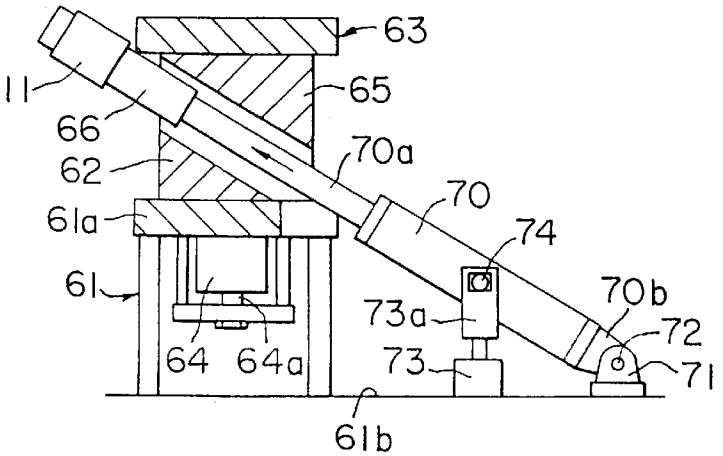

As shown in FIG. 16(D), the punch holder 66 is kept away to a position directed obliquely and upwardly from the lower die 62 and the upper die 65, and the valve device body 11 made of a metallic pipe material is fitted to the locating stepped portion 66*a* of the punch holder 66. Subsequently, the prepared hole 18 provided on the body 11 is aligned with the position where the punch member 33 is moved up and down and, thereafter, the punch holder 66 is pulled back to the position, where it is held between the lower die 62 and the upper die 65, by the cylinder means 70 (FIG. 16(C)).

Further, moving back the lifting cylinder means 73 causes the output part 73*a* connected to the lifting cylinder means 73 to be moved downwardly until the cylinder means 70, punch holder 66 and body 11 are brought into an abutting engagement with the lower die 62 (FIG. 16(B)).

Figure 16A:
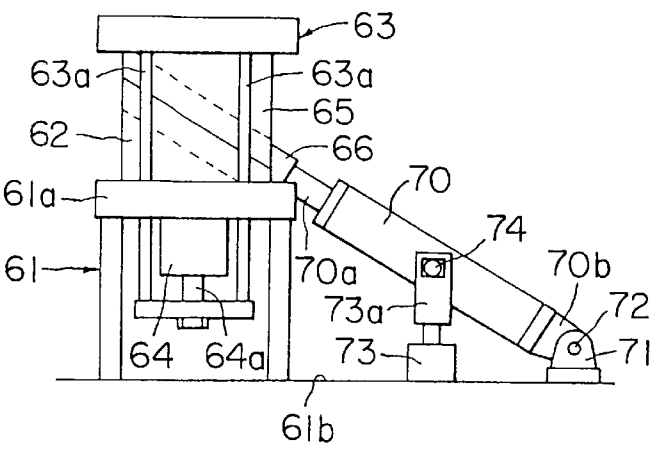

Next, moving forth the hydraulic cylinder means 64 causes the upper die 65 of the lifting frame 63 to be moved downwardly toward the lower die 62 until the body 11 mounted on the punch holder 66 is held between the upper and lower dies (FIG. 16(A)).

The burring process of the valve device body 11 made of a metallic pipe material is performed with the body being held between the upper and lower dies 65 and 62, as shown in FIG. 16(A), thereby forming the tubular flange as described above. Subsequently, after the threaded portion 76*a* of the punch hanger 76 is screwed into the threaded hole 33*c* of the punch member 33, the punch member 33 is pulled up and is shifted to the outside of the punch holder 66, and then, the hydraulic cylinder means 64 is moved back to thereby lift the upper die 65 of the lifting frame 63 so that it is moved away from the body 11 (FIG. 16(B)).

Figure 16C:
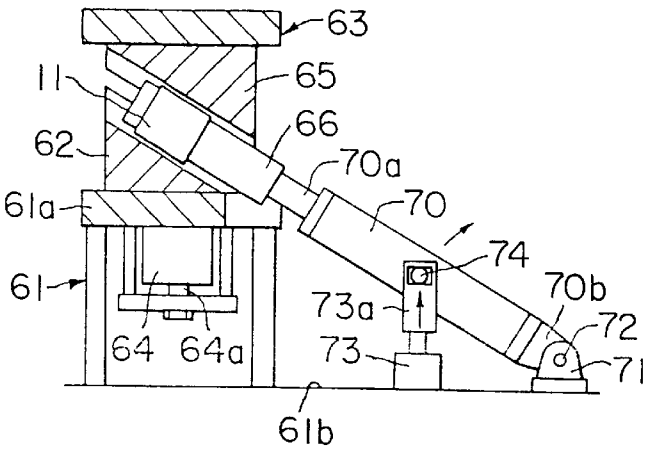

Then, the lifting cylinder means 73 is driven to cause the cylinder means 70 to be pivotally moved about the support shaft 72, thereby moving the punch holder 66 away from the lower die 62 (FIG. 16(C)).

Thereafter, the cylinder means 70 is driven to move the punch holder 66 forth in the obliquely upward direction, and the finished body 11 is taken out from the punch holder 6 (FIG. 16(D)).

Since, in the present invention, the body (work to be processed) 11 can be mounted and dismounted on the punch holder 66 without causing any friction with the upper and lower dies 65 and 62, as described above, no scratching is produced on the surface of the body 11 even if the body made of a soft material such as non-ferrous material is worked.

Figure 17:
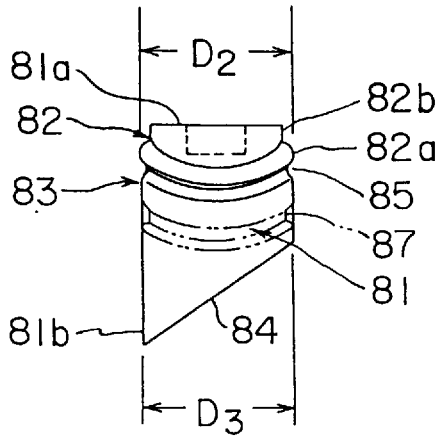
FIG. 17 is a side view showing another embodiment of a punch member used for burring according to the invention.
Figure 18:
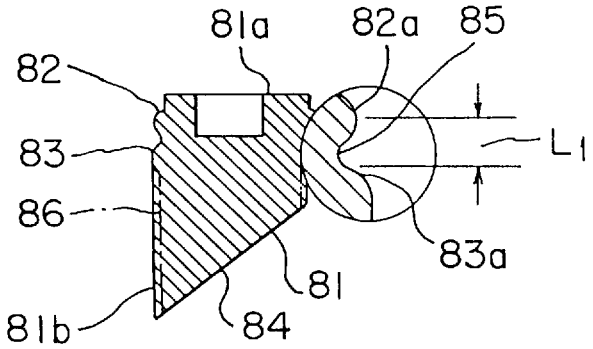
FIG. 18 is a longitudinal sectional view including a partially enlarged view of the punch member shown in FIG. 17.
Figure 19:
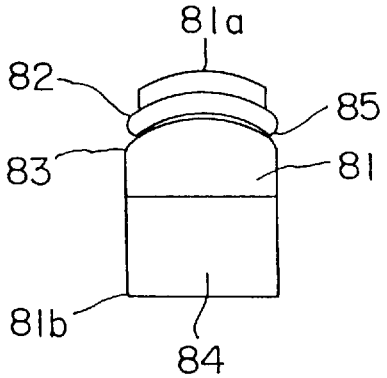
FIG. 19 is a side view of the punch member shown in FIG. 17.

FIGS. 17 to 19 are views showing the other embodiment of a punch member used for a press-burring process according to the invention. The punch member 81 according to the present embodiment is cylindrical in shape, and comprises, in an integral form, a raising part 82 for the former step, a smaller diameter part 85 having a diameter smaller than the outer diameter D2 of the raising part 82 and an ironing part 83 for the latter step continuous in the circumferential direction and having a larger diameter D3 ($D2 \leqq D3$) which is the same as or somewhat greater than that of the raising part 82.

The raising part 82 is composed of a linear introduction part 82*b* which functions to start raising the prepared hole 18 of the body 11, and an enlarging part 82*a* which functions to enlarge the diameter of the hole while raising the hole. Provision of such an introduction part 82*b* allows the process of raising a relatively soft material such as copper alloy or the like to be performed without damaging the material.

In addition, the distance L1 between the enlarged part 82*a* of the raising part 82 formed on the punch member 81 and the front end 83*a* of the ironing part 83 is smaller than the length L2 of the linear portion of the inner peripheral surface of the tubular flange formed by raising the valve device body ($L1<L2$), as shown in FIG. 18 partly in an enlarged scale. The smaller diameter part 8 between the raising part 82 and the ironing part 83 provides an oil pocket.

The rear end of the ironing part 83 is made smaller in the diameter 86, as shown with the one-dot chain line, so that the contact time between the ironing part 83 and the inner peripheral surface of the tubular flange may be made shorter to prevent oil discontinuation or the like.

Besides, a second smaller diameter part 87 may be provided, as shown in FIG. 17 with the two-dot chain line.

Moreover, the end 81*a* of the raising part 82 of the punch member 81 is in the form of a circular arc in the diametrical direction along the shape of the inner peripheral surface of the valve device body, as shown in FIG. 19, so that the entire end surface of the punch member 81 can be brought into contact with the peripheral surface of the prepared hole 18 of the valve device body.

Further, the lower end 81*b* of the punch member 81 is cut so as to form the cut surface 84.

Since, in the present invention, the distance L1 between the raising part 82 formed on the punch member 81 and the ironing part 83 is shorter than the length L2 of the linear portion of the inner peripheral surface of the tubular flange ($L1<L2$), the ironing part 83 of the punch member 81 is positioned on the inner peripheral surface of the base end of the tubular flange during the raising of the tubular flange, so that the ironing is performed by the ironing part 83 subsequently to the raising of the tubular flange. Since the smaller diameter part 85 is provided between the raising part 82 and the ironing part 83, working is discontinued and, simultaneously, the smaller diameter part 85 provides a pocket, whereby the working is smoothly performed.

Besides, as the cross section of the opening of the tubular flange, not only a circular form, but also an arbitrary form such as an oval, a rectangle or the like can be selected.

FIGS. 20 to 24 are views showing another example of the burring process. Namely, in this embodiment, a rotary type of burring apparatus is shown. The burring apparatus 101 comprises a lower die 102, a metal mold 103 having a stepped part 104 and a pull-up mechanism 105, similarly to the above-described embodiment. The pull-up mechanism 105 has a pull-up rod 106 which is driven in normal and reverse rotation by a drive motor (not shown), and the punch member 108 is threadably connected to the end of the pull-up rod 106.

The punch member 108 is cylindrical in shape, and comprises, in an integral form, a raising part 109 at the former step and a ironing part 110 at the latter step having a diameter which is the same as or somewhat greater than that of the raising part 109. Both parts 109 and 110 are continuous in the axial direction and formed by plural stripes of lands 109*a* and 110*a* inclined spirally in the direction of rotation with a predetermined pitch.

Figure 20:
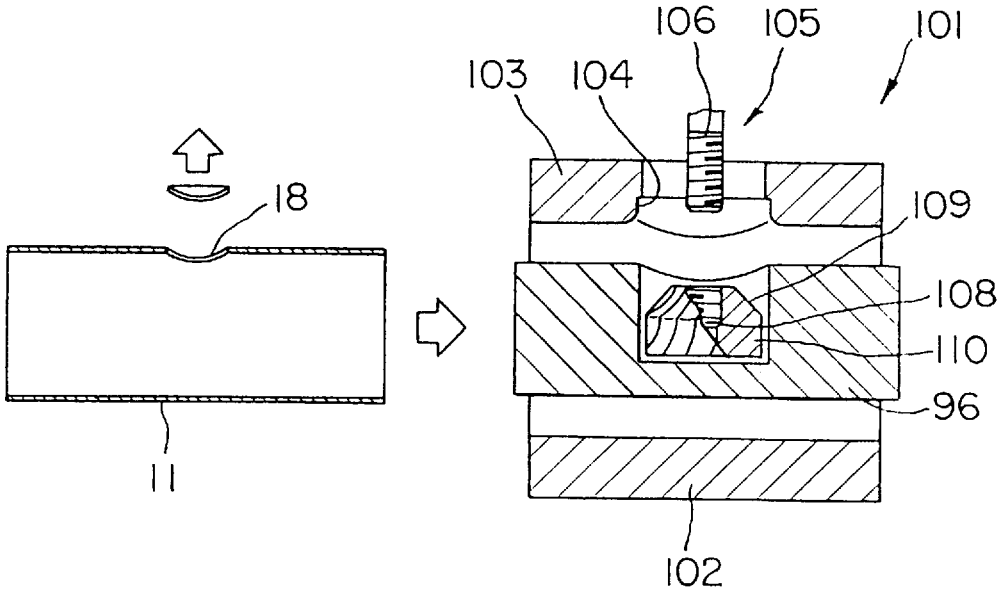
FIG. 20 is a sectional view showing further embodiment of a burring apparatus according to the invention.
Figure 21:
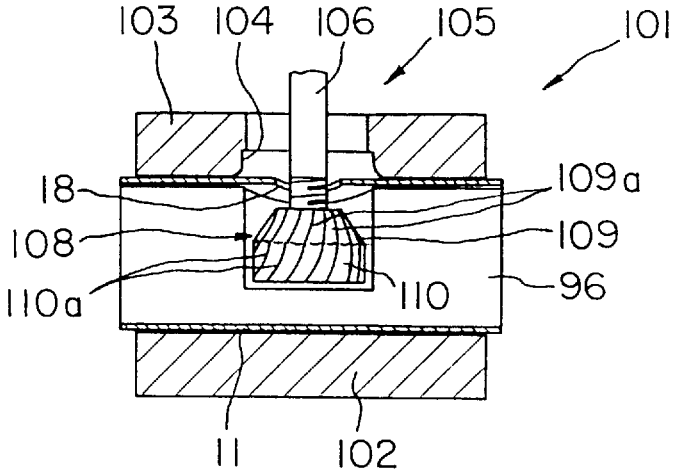
FIG. 21 is a sectional view showing the action of the burring apparatus shown in FIG. 20.

In the case where the burring process is applied to the valve device body 11 made of a metallic pipe material, the punch member 108 is inserted into the punch holder 96 with the lower die 102 and the metal mold 103 being opened, as shown in FIG. 20 and, subsequently, the valve device body 11 is fitted onto the punch holder 96 in the axial direction and mounted thereon. Then, the lower die 102 and the metal mold 103 are moved toward each other and clamped. Thus, the punch member 108 is positioned and arranged in a position corresponding to the prepared hole 18 of the valve device body 11, as shown in FIG. 21. In this situation, the pull-up rod 106 of the pull-up mechanism 105 is moved downwardly, and the end of the rod is threadably connected to the top end of the punch member 108.

Subsequently, the punch member 108 is pulled up outwardly while being rotated in the predetermined direction. This causes the land 109*a* of the raising part 109 of the punch member 108 to come into contact with the inner peripheral surface of the prepared hole 18 of the body 11, so that the peripheral portion of the prepared hole 18 is raised outwardly thereby performing a flaring of the tubular flange 21.

Simultaneously with this operation, the outer peripheral surface of the tubular flange 21 is regulated by the metal mold 103, and the outer peripheral surface of the tubular flange 21 is primarily compressed and deformed at the stepped portion 104 to thereby integrally form the stepped part 24.

Figure 22:
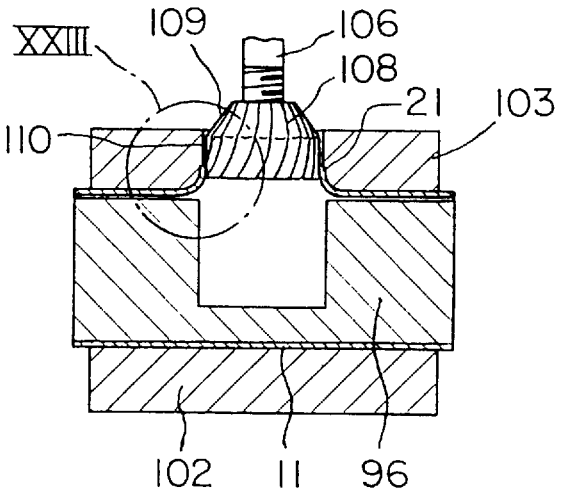
FIG. 22 is a sectional view showing the action of the burring apparatus shown in FIG. 20.
Figure 23:
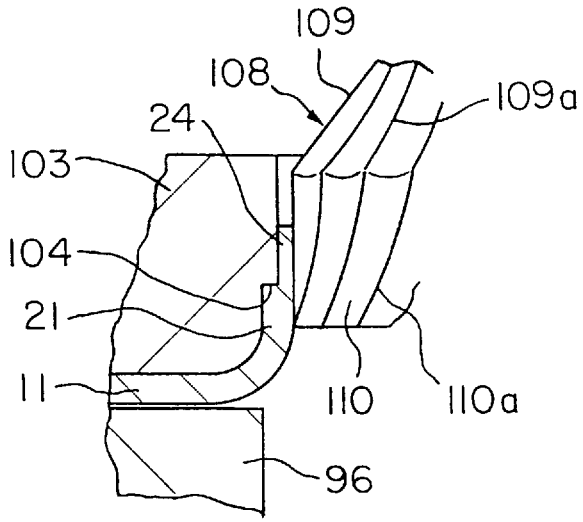
FIG. 23 is a view, on an enlarged scale, of a portion of XXIII in FIG. 22.

When the punch member 108 is further pulled up, the ironing part 110 of the punch member 108 comes to be positioned at the inner peripheral portion of the tubular flange 21, as shown in FIGS. 22 and 23, so that an ironing of the tubular flange 21 is performed. Such an ironing is performed toward the end of the tubular flange 21 in order.

Figure 24:
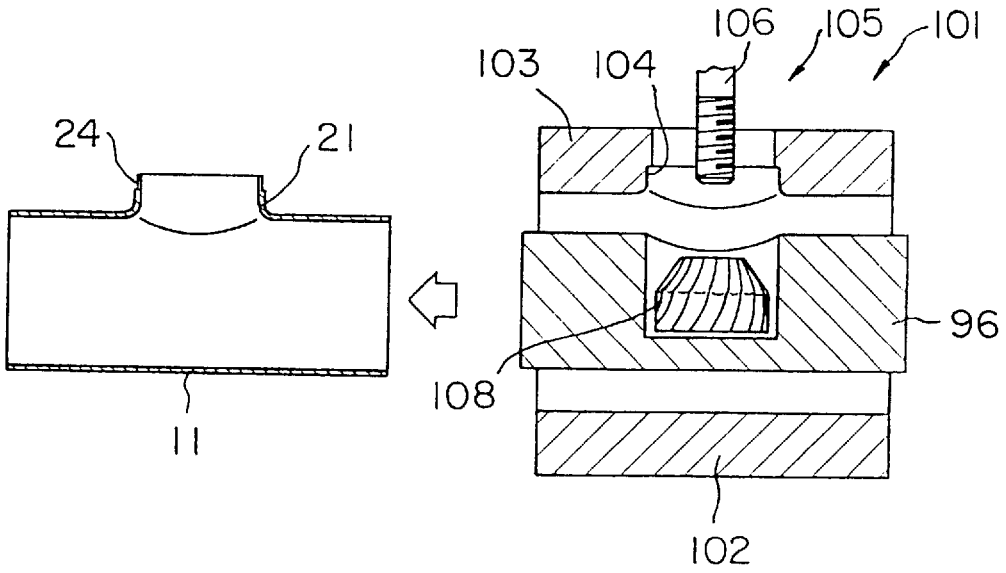
FIG. 24 is a sectional view showing the action of the burring apparatus shown in FIG. 20.

After the rotational burring process for the valve device body 11 has been finished, the pull-up rod 106 is removed from the punch member 108, as shown in FIG. 24, and thereafter, the lower die 102 and the metal mold 103 are opened to take out the valve device body 11. This valve device body 11 is formed with the tubular flange 21 having the stepped portion 24, as shown in FIG. 24.

Adoption of the rotary type of burring method in the present embodiment as described above, allows the tubular flange 21 with the stepped portion 24 to be easily and precisely worked.

Figure 25:
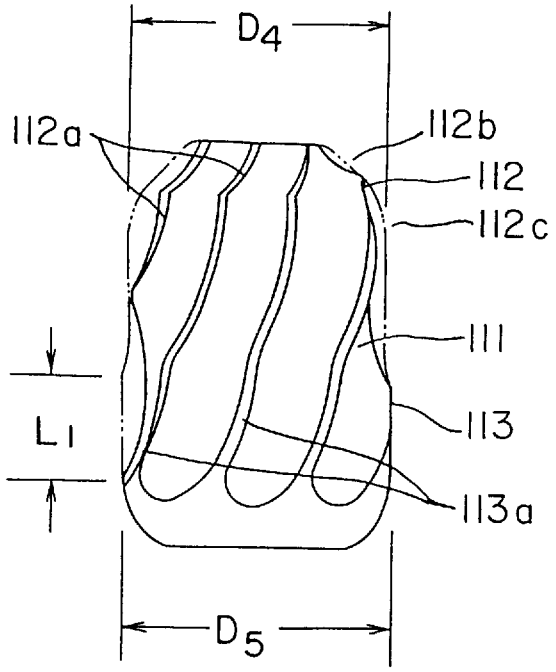
FIG. 25 is a side view showing a still another embodiment of a punch member used for burring according to the invention.
Figure 26:
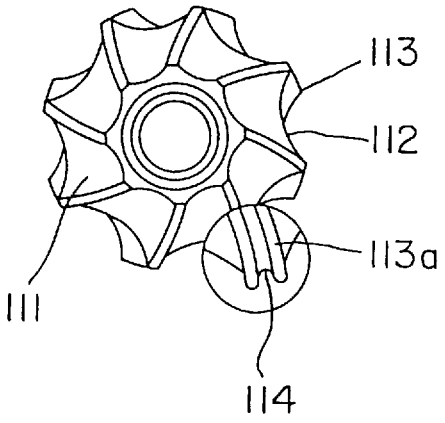
FIG. 26 is a top view of the punch member shown in FIG. 25.

FIGS. 25 and 26 are views showing the other embodiment of the punch member used for the rotational burring process according to the present invention.

The punch member 111 according to the present embodiment is cylindrical in shape and comprises, in an integral form, a raising part 112 at the former step, and an ironing part 113 at the latter step having a diameter D5 which is at least the same as or somewhat greater than the outer diameter D4 of the raising part 112 (D5≧D4). The raising part 112 and the ironing part 113 are formed by plural stripes of lands 112*a* and 113*a* which are continuous in the axial direction and spirally inclined in the direction of rotation with a predetermined pitch.

The raising part 112 is composed of an introduction part 112*b* for starting raising the peripheral edge of the prepared hole provided on the valve device body, and an enlarged part 112*c* for performing a flaring of the tubular flange.

The two-dot chain line in FIG. 25 shows a configuration of the punch member 111 when being rotated.

Further, the length L1 of the ironing part 113 of the punch member 111 is longer than the length L2 of the linear portion of the inner peripheral surface of the tubular flange formed on the valve device body by the raising (L1>L2). In addition, the ironing part 113 is provided with an oil pocket portion 114, as shown in FIG. 26 in a partially enlarged scale.

Since, in the present embodiment, the length L1 of the ironing part of the punch member 111 is longer than the length L2 of the linear portion of the inner peripheral surface of the tubular flange (L1>L2), the ironing part 113 of the punch member 111 is positioned on the inner peripheral surface of the base end of the tubular flange during the raising of the tubular flange, so that the ironing is performed by the ironing part 113 subsequently to the raising process of the tubular flange.

In the above-described embodiments, the example is shown in which the tubular flange is provided on the outer peripheral surface with the stepped portion, to which the inner peripheral surface of the base end of the tubular member for forming a flow passage, for example, of the delivery tube is fitted and joined; however, the outer peripheral surface of the tubular member for forming a flow passage may be fitted and joined to the inner peripheral surface of the tubular flange.

Figure 27:
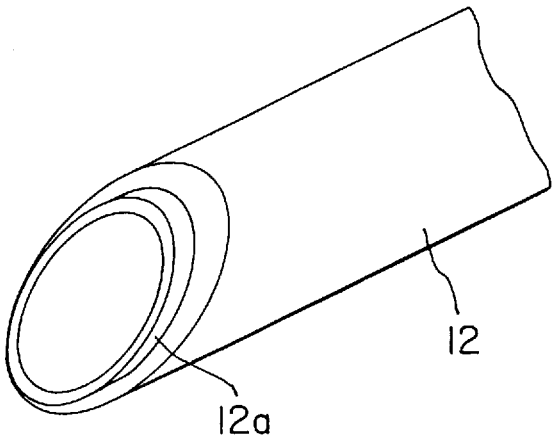
FIG. 27 is an external appearance perspective view showing the base end of a member for forming a flow passage, relating to the further embodiment of burring according to the invention.
Figure 28:
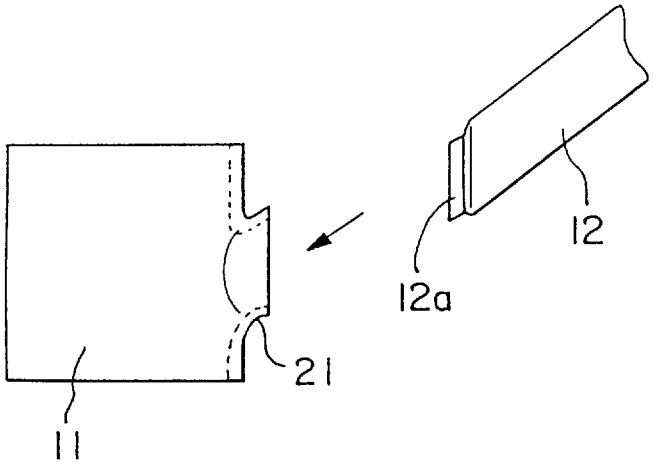
FIG. 28 is an exploded side view showing a situation of joining the member for forming a flow passage shown in FIG. 27.
Figure 29A:
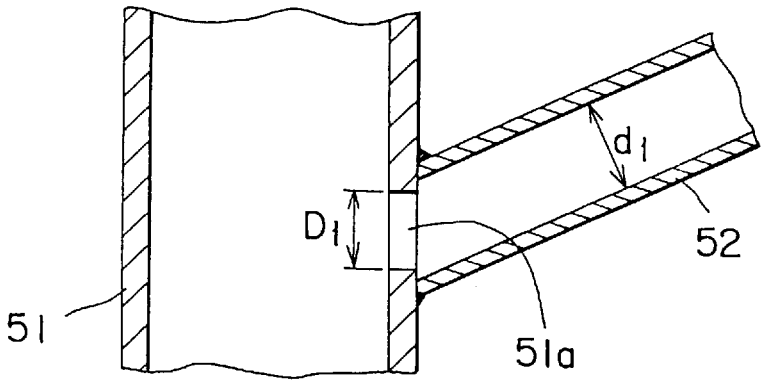
FIG. 29 is a view showing an example of construction of a conventional valve device produced using pipe materials, FIG. 29(*a*) being a side sectional view showing a construction of the valve device body and the member for forming a flow passage being joined to each other, FIG. 29(*b*) being a plan view thereof and FIG. 29(*c*) being an partially external appearance perspective view showing an example of the member for forming a flow passage.
Figure 29B:
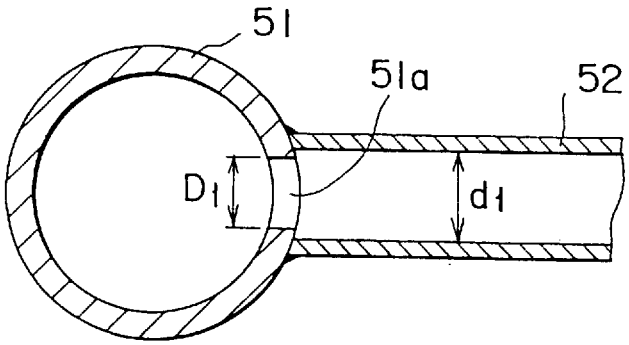
Figure 29C:
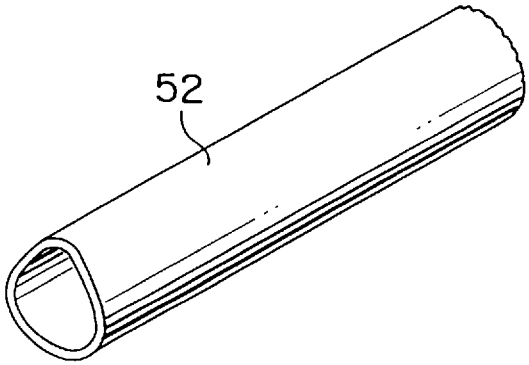

FIGS. 27 and 28 show an embodiment having the construction as described above. In this embodiment, the delivery tube 12 is formed at the base end with a reduced diameter stepped portion 12*a* which is reduced in diameter toward the base end, and the reduced diameter stepped portion 12*a* is fitted into the interior of the tubular flange 21 formed by the burring process in such a manner as described above, whereby the delivery tube 12 is joined to the valve device body 11. In this case, there is no need of forming a stepped portion on the outer peripheral surface of the tubular flange 21.

This embodiment also allows the joined construction of the valve device body and the tubular member for forming a flow passage, which is superior in mechanical strength, to be provided, similarly to the embodiments as described above.

Since, according to the present invention, notwithstanding that a pipe material is used as the valve device body, the valve device body and the member for forming a flow passage at the supply and delivery sides can be firmly joined, the valve device body, which is superior in mechanical strength and can sufficiently bear practical applications, can be provided.

Since joining the valve device body to the member for forming a flow passage is performed using the tubular flange formed by the burring process, the flow passage within the valve device body and the flow passage within the joined member smoothly communicate with each other; so, the valve device body with a steady flow therein, which does not cause noise, erosion or the like, can be provided.

Further, since, according to the present invention, the raising is started from the axial position of the peripheral edge of the prepared hole when the tubular flange is formed by the burring process, the tubular flange which is superior in mechanical strength can be obtained without causing cracking on the raised portion.

The present invention, in the case of being applied to the valve device using a metallic pipe body, provides advantageous effects of improving the mechanical strength and performance of the valve device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of manufacturing a conduit valve device comprising:

forming a opening in a side wall of a conduit, said conduit including an internal volume;

positioning said conduit on a metal mold in a predetermined position;

positioning a punch member within said internal volume of said conduit to a position adjacent said opening; said punch member including first and second diameter portions, said first diameter portion is substantially less than said second diameter portion;

forming flange means for substantially reducing turbulent fluid flow by moving said punch member from the internal volume of said conduit through said opening while raising a peripheral edge portion of said opening with said first diameter of said punch member;

ironing a base portion of said flange means by moving said second diameter portion of the punch member through said opening; and forming a stepped portion on said flange means by pressing said flange means between said mold and said punch member, said flange means substantially reduces turbulent fluid flow while substantially reducing erosion and fluid flow noise.

2. The method of claim 1, wherein said conduit is a first conduit, the method further comprising:

fitting a second conduit onto said flange means, said flange means substantially reduces turbulent fluid flow while substantially reducing erosion, fluid flow noise, and stress concentration regions adjacent said flange means due to externally applied forces on said second conduit.

3. The method of claim 1, wherein said peripheral edge portion includes subportions, said forming flange means step includes raising the subportions of the peripheral edge portion in a sequential manner along a circumference of said opening.

4. The method of claim 3, wherein said subportions are adjacent to each other around the circumference of said opening, said forming flange means step includes raising a first subportion with a first chamfering part, subsequently raising a second subportion with a second chamfering part, subsequently raising a third subportion with a third chamfering part, subsequently raising a fourth subportion with a fourth chamfering part, said subportions are adjacent to each other around a circumference of said opening, said forming flange means step substantially reduces cracking of the peripheral edge.

5. The method of claim 1, further comprising:

rotating said punch member while moving said punch member through said opening.

6. The method of claim 5, further comprising:

raising said peripheral edge portion with a plurality of lands inclined in a spiral manner on said punch member.

7. An apparatus for manufacturing a conduit valve device comprising:

a metal mold having a first curved surface, said mold further includes a tubular cavity disposed within said curved surface;

a die having a second curved surface and is spaced apart from said metal mold;

a conduit having an opening and an internal volume, said conduit is supported by said metal mold and said die;

a punch member movably supported within said conduit, said punch member includes first and second diameter portions, said first diameter portion is substantially less than said second diameter portion;

a punch holder disposed within the conduit and supporting said punch member; and means for moving said punch member from the internal volume of said conduit through said opening and into said tubular cavity of said metal mold to form a flange means integral with and external to said conduit for substantially reducing turbulent fluid flow.

8. The apparatus for manufacturing a conduit valve device of claim 7, wherein said tubular cavity further includes a stepped portion which contacts an edge portion of said flange means after movement of said punch member.

9. The apparatus for manufacturing a conduit valve device of claim 7, wherein said punch member has first and second ends and a mid portion, said first end includes a first chamfering part, said mid portion includes a second chamfering part coaxial with said first chamfering part, said second diameter portion includes said second chamfering part, said first diameter portion includes said first chamfering part, said first and second chamfering parts substantially reduce cracking of said flange means during movement of said punch member.

10. A conduit valve device comprising:

a fluid control mechanism;

a first conduit having a first cross sectional area with a first internal surface and a first external surface, said fluid control mechanism is mounted within said first conduit, said first conduit includes an opening with tubular flange means surrounding said opening on said external surface of said first conduit for substantially reducing turbulent fluid flow, said flange means is integrally formed by said first conduit, said flange means includes a first diameter section and a second diameter section, said first diameter section is greater than said second diameter section; and a second conduit having a second cross sectional area, said second conduit having a second cross sectional area with a second internal surface and a second external surface, said flange means connects said second conduit to said first conduit, said flange means substantially reduces turbulent fluid flow while substantially reducing erosion, fluid flow noise, and stress concentration regions adjacent said flange means due to externally applied forces on said second conduit.

11. The conduit valve device of claim 10, wherein said flange means includes a smooth transition curved portion adjacent said first diameter section extending from the internal surface of said first conduit and extending into said flange means.

12. The conduit valve device of claim 10, wherein said flange means has internal and external surfaces, said flange means includes a stepped portion on the external surface adjacent said second diameter section, and said second internal surface of said second conduit encloses and connects to said stepped portion.

13. The conduit valve device of claim 10, wherein said flange means has internal and external surfaces, said second conduit includes a stepped portion which has a third cross sectional area substantially less than said second cross sectional area and said second diameter section of said flange means, said second diameter section encloses and connects to said stepped portion of said second conduit.

14. The conduit valve device of claim 10, wherein said first cross sectional area of said first conduit is substantially greater than said second cross sectional area of said second conduit.

15. The conduit valve device of claim 10, wherein said flange means has a cross sectional area corresponding to said second diameter section which is substantially less than said first cross sectional area of said first conduit and said second cross sectional area of said second conduit.

* * * * *

UNITED STATES PATENT AND TRADEMARK OFFICE

CERTIFICATE OF CORRECTION

PATENT NO. : 5,829,468

DATED : November 3, 1998

INVENTOR(S) : Hachihei WATANABE et al.

It is certified that error appears in the above-identified patent and that said Letters Patent is here corrected as shown below:

On the Title page, item [30]: Priority Application Data

"5-205690" should correctly read --5-250690--

Signed and Sealed this

Tenth Day of August, 1999

*Attest:*

Q. TODD DICKINSON

*Attesting Officer*

*Acting Commissioner of Patents and Trademarks*